US012495846B2

(12) United States Patent
Garcia et al.

(10) Patent No.: US 12,495,846 B2
(45) Date of Patent: Dec. 16, 2025

(54) PROTECTIVE KNIT SLEEVES

(71) Applicant: ANSELL LIMITED, Richmond (AU)

(72) Inventors: Maria Ines Quaresma Ribeiro Campos Garcia, Lousã (PT); Marco Antonio Francisco Costa, Vila Nova de Poiares (PT); Evan Barna, Chester, NJ (US); Geraldo Alexandre Pimentel De Oliveira, Coimbra (PT); Bruno Emanuel dos Santos Marquez, Vila Nova de Poiares (PT)

(73) Assignee: Ansell Limited, Victoria (AU)

( * ) Notice: Subject to any disclaimer, the term of this patent is extended or adjusted under 35 U.S.C. 154(b) by 9 days.

(21) Appl. No.: 18/033,422

(22) PCT Filed: Oct. 29, 2021

(86) PCT No.: PCT/AU2021/051273

§ 371 (c)(1),
(2) Date: Apr. 24, 2023

(87) PCT Pub. No.: WO2022/087682

PCT Pub. Date: May 5, 2022

(65) Prior Publication Data

US 2023/0389631 A1 Dec. 7, 2023

Related U.S. Application Data

(60) Provisional application No. 63/107,760, filed on Oct. 30, 2020.

(51) Int. Cl.
*A41D 13/08* (2006.01)
*A41D 31/24* (2019.01)

(52) U.S. Cl.
CPC ..... *A41D 13/08* (2013.01); *A41D 31/24* (2019.02); *A41D 2500/10* (2013.01)

(58) Field of Classification Search
None
See application file for complete search history.

(56) References Cited

U.S. PATENT DOCUMENTS 455,700 A * 7/1891 Bourne ..... D04B 1/24 2/241
4,656,842 A * 4/1987 Sawazaki ..... D04B 15/60 66/146

(Continued)

FOREIGN PATENT DOCUMENTS

CN 108505174 A 9/2018
EP 3 722 467 A1 10/2020

(Continued)

OTHER PUBLICATIONS

U.S. Appl. No. 62/986,996 of Blythe U.S. Pat. No. 11,926,937 (Mar. 9, 2020). (Year: 2020).*

(Continued)

*Primary Examiner* — Grace Huang
(74) *Attorney, Agent, or Firm* — Moser Taboada

(57) ABSTRACT

Provided is a knitted protective cut-resistant compressive sleeve configured to protect a human arm, comprising: a contoured tubular body having a length and two ends with openings at both ends, the tubular body formed of a cut-resistant yarn and an elastic yarn, and providing ergonomic or safety improvements.

20 Claims, 3 Drawing Sheets

(56) References Cited

U.S. PATENT DOCUMENTS

| | | | | |
|---|---|---|---|---|
| 4,752,044 | A * | 6/1988 | Memminger | D04B 15/50 66/146 |
| 5,287,709 | A * | 2/1994 | Seino | D04B 15/94 66/8 |
| 5,335,517 | A * | 8/1994 | Throneburg | A43B 17/18 66/49 |
| 6,748,603 | B1 * | 6/2004 | Schmitt | A41D 19/0075 294/1.3 |
| 10,179,186 | B2 * | 1/2019 | Moreland | D04B 1/16 |
| 10,206,439 | B2 * | 2/2019 | Matsuo | D04B 1/22 |
| 11,078,610 | B2 * | 8/2021 | Bibeau | B32B 27/12 |
| 11,208,744 | B2 * | 12/2021 | Urbelis | A41D 31/245 |
| 11,839,242 | B2 * | 12/2023 | Almog | A41C 3/10 |
| 11,926,937 | B2 * | 3/2024 | Blythe | D04B 1/14 |
| 11,957,549 | B2 * | 4/2024 | Pullen | A61B 5/6804 |
| 2001/0047531 | A1 * | 12/2001 | Spies | A41D 13/08 2/22 |
| 2004/0148680 | A1 | 8/2004 | Lehmann | |
| 2005/0086924 | A1 * | 4/2005 | Kolmes | D02G 3/12 57/229 |
| 2006/0042327 | A1 | 3/2006 | Hummel | |
| 2012/0278981 | A1 | 11/2012 | Ialenti | |
| 2014/0165254 | A1 * | 6/2014 | Bowen | A41D 7/008 2/69 |
| 2015/0230552 | A1 * | 8/2015 | Metcalf | A41B 11/002 2/239 |
| 2016/0076175 | A1 * | 3/2016 | Rock | D04B 1/18 66/196 |
| 2017/0071794 | A1 * | 3/2017 | Bazoud | A61F 13/069 |
| 2017/0238636 | A1 | 8/2017 | Einesson | |
| 2017/0354861 | A1 * | 12/2017 | Pärssinen | A63B 71/1225 |
| 2020/0002855 | A1 * | 1/2020 | Aristizabal | D04B 1/22 |
| 2021/0059864 | A1 * | 3/2021 | Reilly | A61F 13/08 |
| 2021/0071323 | A1 * | 3/2021 | Hu | D02G 3/12 |
| 2021/0145084 | A1 * | 5/2021 | Szilagyi | A41D 13/0015 |

FOREIGN PATENT DOCUMENTS

| | | | |
|---|---|---|---|
| WO | WO 2017/062718 | A1 | 4/2017 |
| WO | WO 2018/097737 | A1 | 5/2018 |
| WO | WO 2018/104589 | A1 | 6/2018 |

OTHER PUBLICATIONS

"EN388:2016". Guide Gloves. Nov. 20, 2021. (Year: 2021).*

BS EN 13594:2015 standard (Year: 2015).*

International Search Report for application PCT/AU2021/051273 dated Feb. 9, 2022.

"Medical Compression Hosiery", Deutsches Institut für Gütesicherung und Kennzeichnung E.V., 2008 edition, tagungsmanagement.org/icc/images/stories/PDF/ral_gz_387_englisch.pdf.

Cafuta et al., DIN EN ISO 6330/4G:Feb. 2013, "Suitability-of-lyocell-fiber-for-pillow-fillings" (procedure 4G), Textile Research Journal, 2019, vol. 89(18), pp. 3722-3743.

DIN EN ISO 139:Oct. 2011, Section 3.1, Second edition, 2011, downloaded from: https://standards.iteh.ai/catalog/standards/sist/f70fad6d-df27-489d-9fee-e548484a50e4/iso-139-2005-amd-1-2011, 8 pgs.

EN 407_2004 _Guide Gloves, downloaded from: https://quidegloves.com/en/knowledge/our-products/standards/en-407-2004, 4 pgs. Archived at http://web.archive.org/web/20210401000000*/https://guidegloves.com/en/knowledge/our-products/standards/en-407-2004 on Apr. 21, 2024.

EN388_2003 & 2016 Protective Gloves Against Mechanical Risks, downloaded from: https://skanwear.com/pages/en388-2003-protective-gloves-against-mechanical-risks?srsitid=AfmBOopZMSrWhzeC4P36Yfl1RZnXb1TYyNaDiLR9hMQonEVaXr_K7PZh, 4 pgs. Sep. 26, 2020.

International Standard ISO—13997-1999, "Protective clothing—Mechanical properties—determination of resistance to cutting by sharp objects", downloaded from: https://standards.iteh.ai/catalog/standards/sist/b1d83079-64c1-4267-b265-3feb51cd0e02/iso-13997-1999, Aug. 15, 1999, 9 pgs.

"Medical Compression Armsleeves", Quality Assurance RAL-GZ 387/2, Deutsches Institut für Gütesicherung und Kennzeichnung E.V., Jan. 2008 edition, 19 pgs.

"Textiles—Domestic washing and drying procedures for textile testing", International Standard ISO 6330, Fourth edition, Nov. 2011, https://standards.iteh.ai/catalog/standards/sist/9617e79c-5d3e-4445-bab5-f3cd93169f34/iso-6330-2021, 13 pgs.

* cited by examiner

PROTECTIVE KNIT SLEEVES

BACKGROUND

Field

The present application relates generally to protective knit sleeves for users in a setting having risk of impacts or cuts.

Description of the Related Art

Automotive assembly workers, automotive repair workers, machinists, metal fabricators, meat packing workers, glass workers, sanitation workers, transport workers, miners, foresters, delivery workers, insulation installers and others have enhanced risk of impacts or cuts for which stand-alone protective sleeves are useful. However, existing sleeve designs made typically on flat knitting machines do not include enhanced cut protection in combination with elastic/compression zones, and are not typically formed in an ergonomic shape of the arm or include different types of embroidery designs.

The current invention provides such sleeves with one or more of increased ergonomics, increased cut resistance, good cut resistance more efficiently, increased mobility, or the like.

SUMMARY

Such sleeves, and methods for manufacturing the same, according to embodiments of the disclosure, substantially as shown in and/or described in connection with at least one of the figures, are disclosed. Various advantages, aspects, and novel features of the present disclosure will be more fully understood from the following description and drawings. The foregoing summary is not intended, and should not be contemplated, to describe each embodiment or every implementation of the present disclosure. Other and further embodiments of the present disclosure are described below. Furthermore, changes and modifications can be made to embodiments described herein without departing from the spirit and scope of the present disclosure and without demising the attendant advantages.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only illustrative embodiments of this invention and are therefore not to be considered limiting of its scope, for the invention may admit to other equally effective embodiments. It is to be understood that elements and features of one embodiment may be in other embodiments without further recitation. It is further understood that, where possible, identical reference numerals have been used to indicate comparable elements that are common to the figures.

Figure 1A:
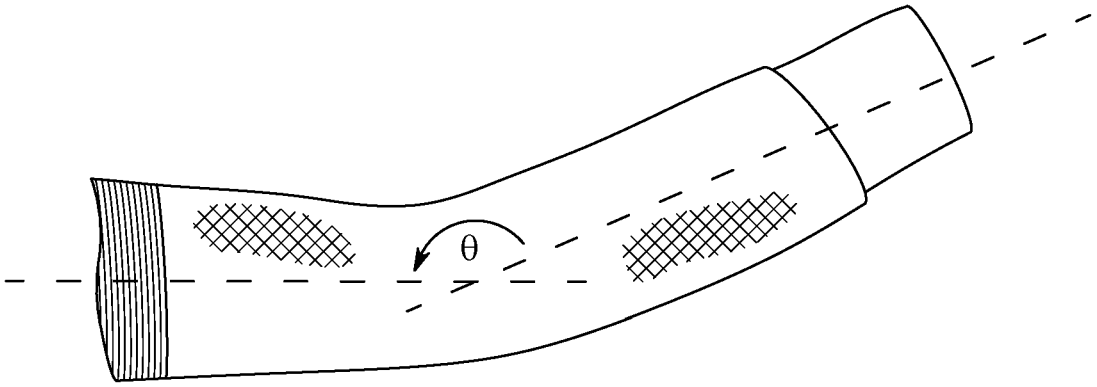
FIGS. 1A and 1B show sleeves of the invention.

To facilitate understanding, identical reference numerals have been used, where possible, to designate comparable elements that are common to the figures. The figures are not drawn to scale and may be simplified for clarity. It is contemplated that elements and features of one embodiment may be beneficially incorporated in other embodiments without further recitation.

DETAILED DESCRIPTION

A "sleeve" relevant to the current claims is one that starts at or near the wrist, or is incorporated into a full or partial glove (e.g., a fingerless glove), and ends so as to cover most of the portion of the bicep that protrudes when tensed.

Figure 1B:
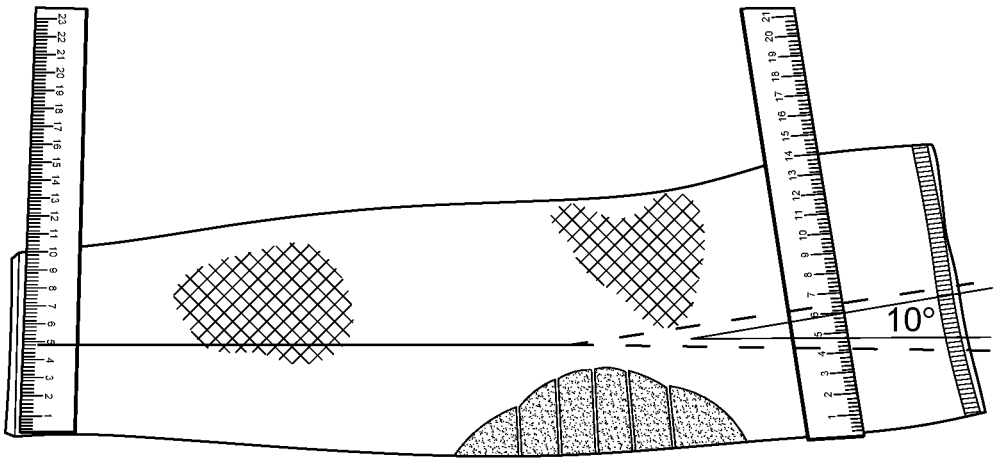

In embodiments, the sleeve forms a hinge shape such that its relaxed shape favors about a 10° angle to about a 50° at the elbow, as indicated by angle θ in FIG. 1A, and further indicated in FIG. 1B. The "relaxed" shape of a sleeve is that which it would form if placed on a flat surface, with the segment aligned with the head of the radius bone defining the fold between the two layers of the sleeve, and with the remaining fabric placed to minimize folds. In embodiments, the sleeve has a padded elbow portion formed by embroidering one or more further yarns onto the sleeve portion such that the relaxed shape angle is defined by a combination of mesh density zones (described below) and padding embroidery (described below). As illustrated in FIG. 1B, flat edges can be used to align the sleeve for measurement.

Figure 2:
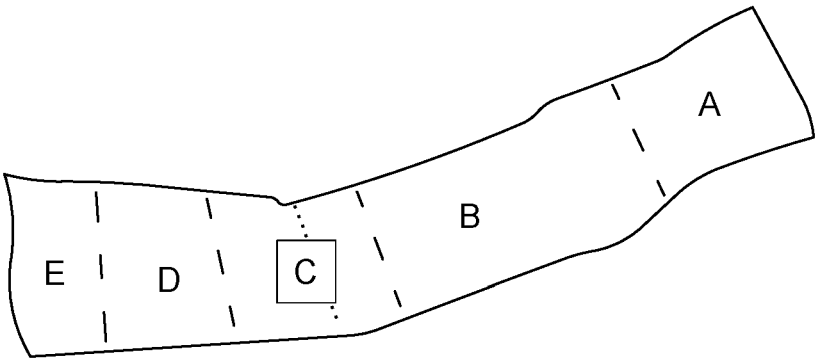
FIG. 2 shows exemplary mesh density zones for a sleeve.

In embodiments, the sleeve can have a plurality of knitting mesh density zones defined along its length (e.g., two, three, four, five or more knitting mesh density zones). For example, there can be zones A, B, C, D and E as illustrated in FIG. 2. The tight dotted line represents the elbow bend.

Figure 3:
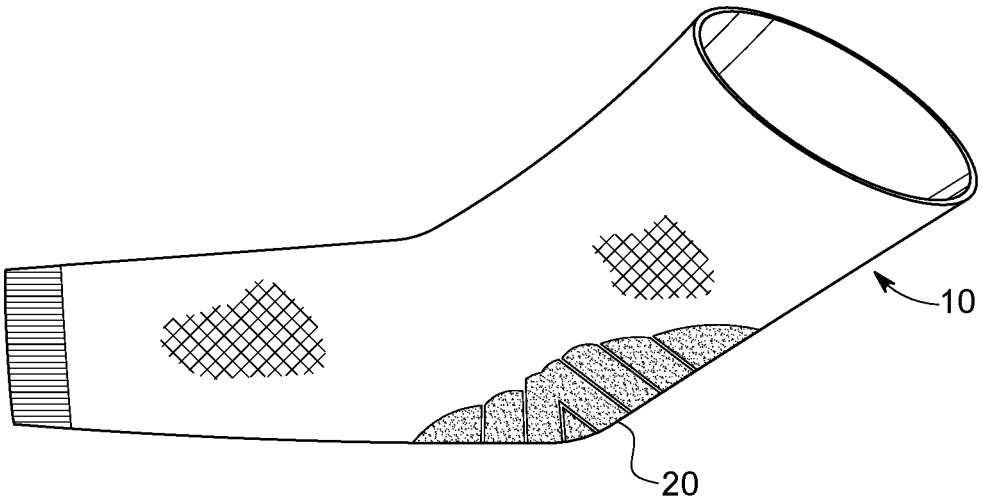
FIG. 3 shows an exemplary elbow pad.

In embodiments, the sleeve 10 has a padded elbow portion 20 formed by embroidering one or more further yarns onto the sleeve portion, as exemplified in FIG. 3. In embodiments, the padded elbow is such that impact to a user's elbow is reduced by about 8% or more, or 10% or more, or 12% or more. In embodiments, testing of the inventive padded elbow showed that impact to a user's elbow is reduced by about an average of 15% or more, or 18% or more as shown in Table 1 below. In embodiments, the pattern of embroidery further enhances the ergonomic angle at the elbow.

Figure 4:
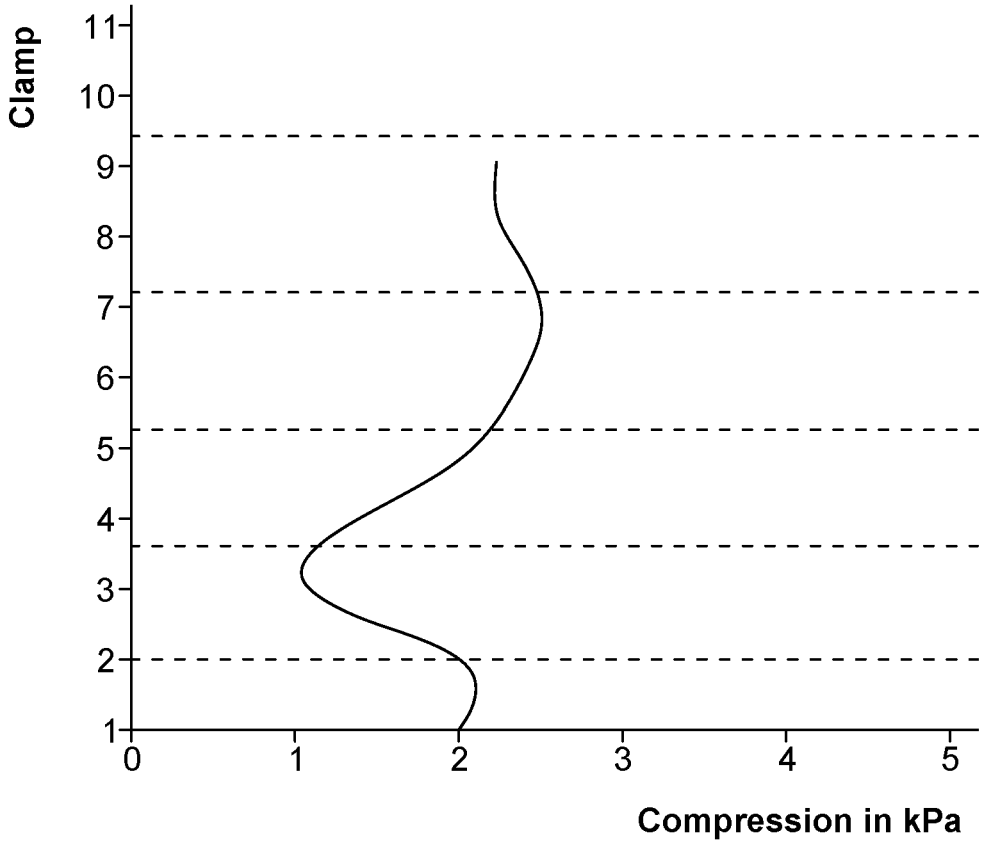
FIG. 4 depicts a compression profile for a sleeve of the invention.

In embodiments, the sleeve has a compression profile that differs from medical compression profile. In embodiments, the profile is configured to ergonomically help the movement of a user in for example one of the fields of work described above. In embodiments, at the mid-forearm in kPa is about 30% or more less than at either the wrist or elbow. An exemplary profile is shown in FIG. 4.

In embodiments, the sleeve has a cut-resistance by EN388:2016 that is increased by about 30% or more, or 35% or more, or 40% or more, relative to a sleeve knitted with only the cut-resistant yarn using the same needle size. In embodiments, the measurement is relative to a sleeve knitted on a flat knitting machine with only the cut-resistant yarn using the same needle size.

In embodiments, the sleeve here described is knitted on a circular knitting machine.

Cut resistance is measured according to EN388 using ISO13997:1999 with a Tomodynamometer (TDM-100). Specifically, the number of newtons needed for a weighted blade to cut through the material over a 20 mm traverse is measured by interpolation of results conducted with a number of weights, using a new blade each time. The measurement is made for portion of the sleeve aligned with the midpoint between head of the radius, and the protrusion at the bottom end of the ulna, designated the mid-forearm (in zone B of FIG. 2). A cut resistance grade of A applies in >2 newtons is needed, B if >5 newtons, C if >10 newtons, D if >15 newtons, E if >22 newtons, and F if >30 newtons.

The measurement elbow angle of the relaxed shape is somewhat inexact, but usefully measured for the angles of relevance. Specifically it is the angle that the humerus and radius would be to one another if an arm were filling the sleeve.

Impact at the elbow is measured by dropping a known weight from a known height [example, 2.5 kg, 80 mm], resulting in a known energy of the impact [1.96 J, in the same example]. The method used is a modification of the standard described in EN 13594:2015, by reducing the height of the drop and tacking the leather patch from below the sample. There is a sensor below the sample to measure the energy transmitted through the sensor. The effect of a protective element is the difference in energy transmitted to the sensor when the protective is present and when it is absent. An alternate measurement uses [100 mm, 2.45 J]. For example, an example of the sleeve, tested with 4 replicants against the same sleeve lacking a padded elbow portion, shows the following average values:

TABLE 1

| 80 mm, 1.96 J | | 100 mm, 2.45 J | |
|---|---|---|---|
| Padded | Non-Padded | Padded | Non-Padded |
| Force @ Peak (kN) 4.83 (−18%) (Avg. of 4.79, 4.92, 4.80, 4.82) | Force @ Peak (kN) 5.91 (Avg. of 6.02, 5.87, 5.94, 5.81) | Force @ Peak (kN) 6.46 (−15%) (Avg. of 6.42, 6.51, 6.55, 6.38) | Force @ Peak (kN) 7.58 (Avg. of 7.81, 7.55, 7.55, 7.41) |

For compression testing, the samples are washed once in accordance with DIN EN ISO 6330/4G: 2013-02 (procedure 4G) and dried at room temperature (procedure C). Then the samples are laid out for 24 hours in normal conditions in accordance with DIN EN ISO 139:2011-10, Section 3.1. Two samples tested per measurement and an average used. The test is carried out at (20±2° C.) and (65±4) % relative humidity, using the RAL-GZ 387/1 standard and particularly the RAL-GZ 387/2 sleeve standard (traverse direction measurement, Deutsches Institut für Gütesicherung und Kennzeichnung E.V., 2008 edition.

The test is based on a standard arm, such as a narrow arm, a wide arm, or an extra wide arm. Exemplified in FIG. 4 is a narrow arm. The device stretches the sleeve to arm circumference at a number of regularly spaced intervals, and measures the pressure. Thus, in FIG. 4, the test points extend from the wrist to the bicep. As shown in FIG. 4, an exemplary compression profile in kPa along the length of the sleeve is shown and summarized below in Table 2.

TABLE 2

| Measuring Point/Clamp | Position along Sleeve (cm) | Pressure/ Compression (kPa) |
|---|---|---|
| 1 | 1 | 2.02 |
| 2 | 6 | 1.95 |
| 3 | 11 | 1.06 |
| 4 | 16 | 1.45 |
| 5 | 21 | 2.10 |
| 6 | 26 | 2.39 |
| 7 | 31 | 2.46 |
| 8 | 36 | 2.25 |
| 9 | 41 | 2.20 |

The tubular body formed of a base yarn and an elastic yarn can also provide enhanced heat resistance relative to a sleeve knitted with only the cut-resistant yarn using the same needle size. In embodiments, the measurement is relative to a sleeve knitted on a flat knitting machine with only the cut-resistant yarn using the same needle size. In embodiments, the sleeve at the mid-forearm is enhanced to meeting an EN 407:2004 level for contact heat, or to level 1, or level 2, or higher, or from one such grade to a higher grade. In level 1, the outside surface of the sleeve is contacted with 100° C. and the standard is met if it takes more than 15 seconds for the temperature on the inside surface to rise 10° C. (from approx. r.t.). In levels 2, 3 and 4, the outside driving temperatures are 250° C., 350° C., and 500° C., respectively. Suitable base yarns include yarns adapted for heat protection, such as Nomex® (Dupont, a meta-aramid yarn) or the like. Sleeves with Nomex for example can meet level 2 with a time of about 16.2 seconds.

Heat and Cut-Resistant Embodiments

In embodiments, the sleeve has an EN388: 2016 cut-resistance of D or higher, and EN 407:2004 level for heat contact of 2 or higher. In embodiments, the cut-resistance is E or higher, or F or higher, with level 2 for heat contact. This can be achieved with a double layer compression sleeve, where the layers are joined. Each layer may be made by single knitting and joined between the layers. This structure creates an air box between both layers improving comfort and heat resistance. A circular knitting machine is usefully employed. A base yarn such as Nomex® can be used.

Applicant has identified a competitor sleeve whose literature recites a cut-resistance of 5 under EN388:2003, and a heat contact of 2 under EN 407:2004. However, Applicant has had its sleeve tested at an independent laboratory for heat contact, and had the competitor sleeve tested at the same laboratory. With the 250° C. test, Applicant's sleeves produced values of 17.0, 18.6 and 18.4 seconds, for a mean of 18.0 seconds, and a standard deviation of 0.88 seconds. Thus, Applicant's sleeves clearly satisfy the 15 seconds or more for a 10° C. rise required by the standard for a rating of 2. The competitor sleeve produced values of 8.2, 9.0 and 8.8 seconds, for a mean of 8.7 seconds, and a standard deviation of 0.41 seconds. These values fail the standard for a rating of 2.

FURTHER ASPECTS OF THE INVENTION

The sleeves of the invention can have any of the options described below.

It has been discovered that the cut resistance of a sleeve can be enhanced by use of a circular knitting machine with a cut-resistant yarn and an elastic yarn whose elastic yarn tension can be programmed as the knitting machine progresses in forming the sleeve. This increase, relative to a sleeve made without elastic yarn, can be quite dramatic. For example, a sleeve based on a glass fiber yarn can go from a cut resistance of C (14 newton) to D (20 newton) by ISO13997:1999. Thus, extremely good cut resistances can be achieved with economical yarns, like a combination of cotton, polyamide and glass yarn.

Yarns that can be used in embodiments of the invention include, for example, cut resistant yarns and yarns that are not conventionally known as cut resistant (but which may provide cut resistance) as follows: high performance polyethylene (HPPE), glass fiber, cotton, polyamides, polyesters, and yarns that are blends to one or more of the above or one or more of the above and other yarns.

Using one or more of the above yarns along with various amounts of elastic and a ribbed design in the circular knitted machine, cut resistance of the sleeve is increased by 30% or more over traditional flat knitted sleeves using the same yarns. In some embodiments, cut resistance of the sleeve is increased by 45% or more over traditional flat knitted sleeves using the same yarns.

In embodiments, the sleeve is primarily made with single knitting. In embodiments, single knitting is jersey, French terry, sweatshirt fleece, plated or the like. By "primarily" it is meant that the major part of the sleeve fabric by area is as described. Cut resistance features apply to that primary portion. Specifically, as an exception, padded elbows (formed by embroidering one or more further yarns onto the sleeve portion) may provide still more cut resistance at the padded portion, but such further enhancements would be described relative to the padded portion.

The compression profile shown in FIG. 4 is one option for a sports profile, i.e., an ergonomically assisting profile. Sports profiles of the invention can help prevent shifting of the sleeve while leaving the arm free to flex as needed for the user's activity. Such profiles can provide improved comfort and/or assist in making an ergonomic shape for the sleeve. In embodiments, sports profiles can provide less compression than may apply to a medical compression sleeve.

The padded elbow portion formed by embroidering with a circular knitting machine is very effective in reducing the force of an impact that is transferred to a user's elbow. This reduction is believed to be accentuated by the seamless incorporation by embroidery of extra material at the elbow, such as with circular knitting. Moreover, the knitting process is integrated into a single knitting process, providing extra impact resistance.

Unexpectedly, the manner of knitting the padded elbow allows for the sleeve to have a better at-rest ergonomic shape. This shape can be further enhanced by adjusting the elastic yarn tension during formation of the sleeve.

During most of an industrial activity, the elbow is bent to some degree. Moreover, during the activity a user must bend his elbow still further. With a non-ergonomic shape, the user must expend extra force on the sleeve fabric to put the elbow into a base shape where there is some bend. Then, to bend the elbow to a maximum for the activity, it must further distort the sleeve fabric. In contrast, with the ergonomic sleeves of the invention no distorting force is needed to achieve the base shape, less is needed to go from the base shape to the maximum bend, and even the force needed to straighten the elbow is modest.

In embodiments, the protective sleeve is hinge shaped by the padded elbow portion such that its relaxed shape favors about a 10° angle to about a 50° at the elbow.

Specific embodiments according to the methods of the present invention will now be described in the following examples. The examples are illustrative only, and are not intended to limit the remainder of the disclosure in any way.

All ranges recited herein include ranges therebetween, and can be inclusive or exclusive of the endpoints. Optional included ranges are from integer values therebetween (or inclusive of one original endpoint), at the order of magnitude recited or the next smaller order of magnitude. For example, if the lower range value is 0.2, optional included endpoints can be 0.3, 0.4, . . . 1.1, 1.2, and the like, as well as 1, 2, 3 and the like; if the higher range is 8, optional included endpoints can be 7, 6, and the like, as well as 7.9, 7.8, and the like. One-sided boundaries, such as 3 or more, similarly include consistent boundaries (or ranges) starting at integer values at the recited order of magnitude or one lower. For example, 3 or more includes 4 or more, or 3.1 or more. If there are two ranges mentioned, such as about 1 to 10 and about 2 to 5, those of skill will recognize that the implied ranges of 1 to 5 and 2 to 10 are within the invention.

Where a sentence states that its subject is found in embodiments, or in certain embodiments, or in the like, it is applicable to any embodiment in which the subject matter can be logically applied.

This invention described herein is of a protective sleeve and methods of forming the same. Although some embodiments have been discussed above, other implementations and applications are also within the scope of the following claims. Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the following claims. More specifically, those of skill will recognize that any embodiment described herein that those of skill would recognize could advantageously have a sub-feature of another embodiment, is described as having that sub-feature.

The invention can be further described with reference to the following numbered embodiments:

Sleeve Embodiment 1. A knitted protective cut-resistant compressive sleeve configured to protect a human arm, comprising: a contoured tubular body having a length and two ends with openings at both ends, the tubular body formed of a cut-resistant yarn and an elastic yarn; the sleeve such that one or more of the following applies: (a) the sleeve forms a hinge shape such that its relaxed shape favors about a 10° angle to about a 50° angle at the elbow; or (b) the sleeve is knitted with a plurality of mesh density zones defined along the length (e.g., 2, 3, 4, 5 or more mesh density zones); or (c) the sleeve has a padded elbow portion formed by embroidering one or more further yarns onto the sleeve portion such that impact to a user's elbow is reduced by about 8% or more; or (d) the sleeve provides a compression profile wherein compression at the mid-forearm in kPa is about 30% or more less than at either the wrist or elbow; or (e) the sleeve has a cut-resistance by EN388 that is increased by about 30% or more relative to a sleeve knitted with only the cut-resistant yarn using the same needle size.

Sleeve Embodiment 2. The knitted protective cut-resistant compressive sleeve of a Sleeve Embodiment, wherein (a) the sleeve forms a hinge shape such that its relaxed shape favors about a angle to about a 50° angle at the elbow.

Sleeve Embodiment 3. The knitted protective cut-resistant compressive sleeve of a Sleeve Embodiment, wherein (b) the sleeve is knitted with four or more, or five or more, mesh density zones defined along the length.

Sleeve Embodiment 4. The knitted protective cut-resistant compressive sleeve of a Sleeve Embodiment, wherein (c) the sleeve has a padded elbow portion formed by embroidering one or more further yarns onto the sleeve portion such that impact to a user's elbow is reduced by about 8% or more.

Sleeve Embodiment 5. The knitted protective cut-resistant compressive sleeve of a Sleeve Embodiment, wherein (d) the sleeve provides a compression profile defined by a maximum compression A within about 4 cm of the wrist and a maximum compression B within about 3 cm of the elbow on the wrist side, wherein compression at a compression local minimum at a point C therebetween in kPa is about 20% or more, optionally about 25% or more, optionally about 30% or more, less than at either t A or B (wherein a local minimum means that there are greater values immediately above and below point C).

Sleeve Embodiment 5A. The knitted protective cut-resistant compressive sleeve of a Sleeve Embodiment, wherein (d1) the sleeve provides a compression profile wherein compression at a second local minimum at a point D therebetween in kPa is about 20% or more, optionally about 25% or more, optionally about 30% or more, less than at either A or B.

Sleeve Embodiment 5B. The knitted protective cut-resistant compressive sleeve of a Sleeve Embodiment, wherein (d2) the sleeve provides a compression profile wherein compression at a local maximum at a point E located above the elbow is more than at A or B.

Sleeve Embodiment 5C. The knitted protective cut-resistant compressive sleeve of a Sleeve Embodiment, wherein (d2) the sleeve provides a compression profile wherein compression at a local maximum at a point E located above the elbow is about 10% or more, optionally about 15% or more, optionally about 20% or more, more than at A or B (wherein a local maximum means that there are lesser values immediately above and below point E).

Sleeve Embodiment 5D. The knitted protective cut-resistant compressive sleeve of a Sleeve Embodiment, wherein (d3) the sleeve provides a compression profile wherein compression at the top of the sleeve in kPa is greater than at point E.

Sleeve Embodiment 6. The knitted protective cut-resistant compressive sleeve of a Sleeve Embodiment, wherein (e) the sleeve has a cut-resistance by EN388 that is increased by about 30% or more relative to a sleeve knitted with only the cut-resistant yarn using the same needle size.

Sleeve Embodiment 7. A knitted protective cut-resistant compressive sleeve of a Sleeve Embodiment, wherein (f) the sleeve has an EN388:2016 cut-resistance of D or higher, and EN 407:2004 level for heat contact of 2 or higher.

Sleeve Embodiment 7A. A knitted protective cut-resistant compressive sleeve of a Sleeve Embodiment, wherein (f1) the sleeve has an EN388:2016 cut-resistance of E or higher, and EN 407:2004 level for heat contact of 2 or higher.

Sleeve Embodiment 7B. A knitted protective cut-resistant compressive sleeve of a Sleeve Embodiment, wherein (f2) the sleeve has an EN388:2016 cut-resistance of E or higher, and EN 407:2004 level for heat contact of 2 or higher.

Sleeve Embodiment 10. A knitted protective cut-resistant compressive sleeve of a Sleeve Embodiment, wherein the sleeve is a double layer compression sleeve, where the layers are combined with terry loop.

Sleeve Embodiment 11. A knitted protective sleeve of a Sleeve Embodiment, knitted with a circular knitting machine with programmable tension on the elastic yarn.

Sleeve Embodiments 12. As indicated above, a knitted protective sleeve of a Sleeve Embodiment comprising any combination of 2 of Embodiments 2 to 7 (2+3, 2+4, 2+5, 2+6, 2+7, 3+4, 3+5, 3+6, 3+7, 4+5, 4+6, 4+7, 5+6, 5+7, 6+7)(inclusive of any of or more one of Embodiments 5, 5A, 5B, 5C, 5D, 7, 7A or 7B).

Sleeve Embodiments 13. As indicated above, a knitted protective sleeve of a Sleeve Embodiment comprising any combination of 3 of Embodiments 2 to 7 (2+3+4, 2+3+5, 2+3+6, 2+3+7, 2+4+5, 2+4+6, 2+4+7, 2+5+6, 2+5+7, 2+6+7, 3+4+5, 3+4+6, 3+4+7, 3+5+6, 3+5+7, 3+6+7, 4+5+6, 4+5+7, 4+6+7, 5+6+7) (inclusive of any or more of one of Embodiments 5, 5A, 5B, 5D, 7, 7A or 7B)(inclusive of any of one of Embodiments 5, 5A, 5B, 5C, 5D, 7, 7A or 7B).

Sleeve Embodiments 14. As indicated above, a knitted protective sleeve of a Sleeve Embodiment comprising any combination of 4 of Embodiments 2 to 7 (2+3+4+5, 2+3+4+6, 2+3+4+7, 2+3+5+6, 2+3+5+7, 2+3+6+7, 2+4+5+6, 2+4+5+7, 2+4+6+7, 2+5+6+7, 3+4+5+6, 3+4+5+7, 3+4+6+7, 3+5+6+7, 4+5+6+7)(inclusive of any of one or more of Embodiments 5, 5A, 5C, 5D, 7, 7A or 7B).

Sleeve Embodiments 15. As indicated above, a knitted protective sleeve of a Sleeve Embodiment comprising any combination of 5 of Embodiments 2 to 7 (2+3+4+5+6, 2+3+4+5+7, 2+3+4+6+7, 2+3+5+6+7, 2+4+5+6+7, 3+4+5+6+7)(inclusive of any of one or more of Embodiments 5, 5A, 5B, 5C, 5D, 7, 7A or 7B).

Sleeve Embodiments 16. As indicated above, a knitted protective sleeve of a Sleeve Embodiment comprising all of Embodiments 2 to 7 (inclusive of any of one or more of Embodiments 5, 5A, 5B, 5C, 5D, 7, 7A or 7B).

Sleeve Embodiment 17. A knitted protective sleeve of a Sleeve Embodiment, wherein the cut-resistant yarn has or comprises metal (e.g. a metallic fiber) in a core.

Sleeve Embodiment 18. A knitted protective sleeve of Sleeve Embodiment utilizing a metallic core cut-resistant yarn, wherein the metallic core comprises steel or tungsten.

Sleeve Embodiment 19. A knitted protective sleeve of Sleeve Embodiment utilizing a metallic core cut-resistant yarn, wherein the metallic core comprises or is tungsten.

Sleeve Embodiment 20. A knitted protective sleeve of Sleeve Embodiment utilizing a metallic core cut-resistant yarn, wherein the metallic core is about 22 to about 28 micron in diameter.

Sleeve Embodiment 21. A knitted protective sleeve of Sleeve Embodiment utilizing a metallic core cut-resistant yarn, wherein the metallic core is sheathed with para-aramid yarn.

Sleeve Embodiment 22. A knitted protective sleeve of Sleeve Embodiment utilizing a metallic core cut-resistant yarn, wherein the metallic core comprises about 35 to about 45 wt % of the cut-resistant yarn.

Sleeve Embodiment 23. A knitted protective sleeve of Sleeve Embodiment utilizing a metallic core cut-resistant yarn, wherein para-aramid yarn sheathing comprises about 55 to about 65 wt % of the cut-resistant yarn.

Sleeve Embodiment 24. A knitted protective sleeve of Sleeve Embodiment utilizing a metallic core cut-resistant yarn, wherein the core further comprises glass fiber.

Sleeve Embodiment 25. A knitted protective sleeve of Sleeve Embodiment utilizing a metallic/glass core cut-resistant yarn, wherein the yarn sheathing further comprises one or more of HPPE and nylon.

Sleeve Embodiment 26. A knitted protective sleeve of Sleeve Embodiment utilizing a metallic/glass core cut-resistant yarn, wherein the yarn sheathing further comprises HPPE and nylon.

Sleeve Embodiment 27. A knitted protective sleeve of Sleeve Embodiment utilizing a metallic core cut-resistant yarn, wherein the sleeve has a cut-resistance of F or higher.

Sleeve Embodiment 28. A knitted protective sleeve of Sleeve Embodiment utilizing a metallic core cut-resistant yarn, wherein the sleeve has an EN 407:2004 level for heat contact of 2 or higher.

Sleeve Embodiment 29. A knitted protective sleeve of a Sleeve Embodiment, wherein the sleeve is knitted in gauge 15.

Method Embodiment 1. A method of knitting a protective sleeve of a Sleeve Embodiment, wherein the sleeve is knitted with a circular knitting machine with programmable tension on the elastic yarn.

Method Embodiment 2. A method of knitting a protective sleeve of a Method Embodiment, further comprising embroidering the padded elbow portion with a circular knitting machine.

Publications and references, including but not limited to patents and patent applications, cited in this specification are herein incorporated by reference in their entirety in the entire portion cited as if each individual publication or reference were specifically and individually indicated to be incorporated by reference herein as being fully set forth. Any patent application to which this application claims priority is also incorporated by reference herein in the manner described above for publications and references.

The invention claimed is:

1. A knitted protective cut-resistant compressive sleeve configured to protect a human arm, the sleeve consisting of a single tubular body having a length and two ends with openings at both ends, the tubular body formed of a cut-resistant yarn and an elastic yarn, wherein the sleeve provides a compression profile, wherein there are first, second, and third mesh density zones that are sequential along the length, wherein the compression at the first and third mesh density zones is greater than at the second mesh density zone, and wherein the sleeve is formed such that one or more of the following applies:

(a) the sleeve forms a hinge shape such that its relaxed shape favors about a 10° angle to about a 50° angle at an elbow portion of the sleeve;

(b) the sleeve is knitted with four or more, or five or more, mesh density zones defined along the length; or (c) the elbow portion of the sleeve has padding formed by embroidering one or more further yarns onto the tubular body, the one or more further yarns being at least one of the cut resistant yarn or the elastic yarn.

2. The knitted protective cut-resistant compressive sleeve of claim 1, wherein (a) the sleeve forms the hinge shape such that its relaxed shape favors about the 10° angle to about the 50° angle at the elbow portion of the sleeve.

3. The knitted protective cut-resistant compressive sleeve of claim 1, wherein (b) the sleeve is knitted with the four or more, or five or more, mesh density zones defined along the length.

4. The knitted protective cut-resistant compressive sleeve of claim 1, wherein (c) the elbow portion of the sleeve has the padding formed by the embroidering of the one or more further yarns onto the tubular body, wherein the one or more further yarns being at least one of the cut resistant yarn or the elastic yarn.

5. The knitted protective cut-resistant compressive sleeve of claim 1, wherein the sleeve is formed such that (d) the sleeve has an EN 407:2004 level for heat contact of at least 2.

6. The knitted protective cut-resistant compressive sleeve of claim 1, wherein the sleeve is formed such that (d) the sleeve has an EN388: 2016 cut-resistance of at least D.

7. The knitted protective cut-resistant compressive sleeve of claim 1, wherein the sleeve is formed such that (d) the sleeve has an EN388: 2016 cut-resistance of at least F.

8. The knitted protective cut-resistant compressive sleeve of claim 1, wherein the cut-resistant yarn comprises a core comprising metal fiber.

9. The knitted protective cut-resistant compressive sleeve of claim 8, wherein the metal fiber comprises tungsten.

10. The knitted protective cut-resistant compressive sleeve of claim 1, wherein the sleeve is a double layer compression sleeve.

11. The knitted protective cut-resistant compressive sleeve of claim 1, knitted with a circular knitting machine with programmable tension on the elastic yarn.

12. A method of knitting the protective sleeve of claim 1, wherein the sleeve is knitted with a circular knitting machine with programmable tension on the elastic yarn.

13. The method of claim 12, wherein (c) the elbow portion of the sleeve has the padding formed by the embroidering of the one or more further yarns onto the tubular body, wherein the one or more further yarns being at least one of the cut resistant yarn or the elastic yarn, the method further comprising forming the padding of the elbow portion of the sleeve by embroidering the one or more further yarns onto the sleeve with the circular knitting machine.

14. The knitted protective cut-resistant compressive sleeve of claim 1, wherein the first mesh density zone corresponds to a wrist zone of the sleeve, the second mesh density zone corresponds to a forearm zone of the sleeve, and the third mesh density zone corresponds to an elbow zone of the sleeve.

15. A knitted protective cut-resistant compressive sleeve configured to protect a human arm, the sleeve consisting of a single tubular body having a length and two ends with openings at both ends, wherein the tubular body is formed of a cut-resistant yarn comprising metal fiber and an elastic yarn, and wherein the sleeve has an EN388: 2016 cut-resistance of at least D and wherein the sleeve provides a compression profile, wherein there are first, second, and third mesh density zones that are sequential along the length, wherein the compression at the first and third mesh density zones is greater than at the second mesh density zone.

16. The knitted protective cut-resistant compressive sleeve of claim 15, wherein the sleeve has an EN388: 2016 cut-resistance of at least F.

17. The knitted protective cut-resistant compressive sleeve of claim 16, wherein the metal fiber comprises tungsten.

18. The knitted protective cut-resistant compressive sleeve of claim 15, wherein the sleeve is knitted with four or more mesh density zones defined along the length.

19. The knitted protective cut-resistant compressive sleeve of claim 15, wherein the sleeve has an EN 407:2004 level for heat contact of 2 or higher.

20. The knitted protective cut-resistant compressive sleeve of claim 15, wherein the first mesh density zone corresponds to a wrist zone of the sleeve, the second mesh density zone corresponds to a forearm zone of the sleeve, and the third mesh density zone corresponds to an elbow zone of the sleeve.

* * * * *